US011101598B2

(12) United States Patent
Johannes et al.

(10) Patent No.: US 11,101,598 B2
(45) Date of Patent: Aug. 24, 2021

(54) DRY MATE ROTATABLE CONNECTOR

(71) Applicant: SMITHS INTERCONNECT AMERICAS, INC., Kansas City, KS (US)

(72) Inventors: Richard A. Johannes, Trabuco Canyon, CA (US); Robert Milligan, Costa Mesa, CA (US)

(73) Assignee: SMITHS INTERCONNECT AMERICAS, INC., Kansas City, KS (US)

( * ) Notice: Subject to any disclaimer, the term of this patent is extended or adjusted under 35 U.S.C. 154(b) by 12 days.

(21) Appl. No.: 16/613,515

(22) PCT Filed: May 11, 2018

(86) PCT No.: PCT/US2018/032442
§ 371 (c)(1),
(2) Date: Nov. 14, 2019

(87) PCT Pub. No.: WO2018/217480
PCT Pub. Date: Nov. 29, 2018

(65) Prior Publication Data

US 2020/0076119 A1 Mar. 5, 2020

Related U.S. Application Data

(60) Provisional application No. 62/509,658, filed on May 22, 2017.

(51) Int. Cl.
*H01R 13/64* (2006.01)
*H01R 13/52* (2006.01)
(Continued)

(52) U.S. Cl.
CPC ..... *H01R 13/5219* (2013.01); *H01R 13/17* (2013.01); *H01R 24/38* (2013.01)

(58) Field of Classification Search
CPC .. H01R 13/631; H01R 13/6205; H01R 39/34; H01R 13/633; H01R 13/635
(Continued)

(56) References Cited

U.S. PATENT DOCUMENTS 4,421,371 A * 12/1983 Clark ..... H01R 13/631 439/249
6,190,616 B1 2/2001 Jovanovich et al.
(Continued)

OTHER PUBLICATIONS

International Search Report and Written Opinion of the International Searching Authority (dated Oct. 19, 2018) for Corresponding International PCT Patent Application No. PCT/US18/032442, filed May 11, 2018.

*Primary Examiner* — Phuong Chi Thi Nguyen
(74) *Attorney, Agent, or Firm* — Snell & Wilmer LLP

(57) ABSTRACT

A coupler for electrical connectors. The coupler includes a body having a first end and a second end opposite the first end. The coupler further includes a first connection interface positioned at the first end of the body, the first connection interface having a first set of conductive rings. The coupler further includes a second connection interface positioned at the second end of the body, the second connection interface having a second set of conductive rings electrically connected to the first set of conductive rings.

11 Claims, 6 Drawing Sheets

(51) Int. Cl.
*H01R 13/17* (2006.01)
*H01R 24/38* (2011.01)

(58) Field of Classification Search
USPC ..... 439/249, 39, 40, 22, 923, 180
See application file for complete search history.

(56) References Cited

U.S. PATENT DOCUMENTS

| | | | | |
|---|---|---|---|---|
| 6,976,862 | B1 | 12/2005 | Ormazabal Ocerin | |
| 7,056,127 | B2 * | 6/2006 | Suzuki ..... | H01R 13/6205 439/22 |
| 9,325,096 | B2 * | 4/2016 | Ma ..... | H01R 13/2464 |
| 2013/0059474 | A1 | 3/2013 | Hall et al. | |
| 2016/0233608 | A1 | 8/2016 | Burrow et al. | |
| 2016/0322739 | A1 | 11/2016 | Taylor et al. | |

* cited by examiner

DRY MATE ROTATABLE CONNECTOR

CROSS-REFERENCE TO RELATED APPLICATIONS

This application claims priority to and the benefit of U.S. Provisional Application No. 62/509,658, titled "DRY MATE ROTATABLE CONNECTOR," filed on May 22, 2017, and the entirety of which is hereby incorporated by reference herein.

BACKGROUND

1. Field of the Invention

This specification relates to an electrical connector assembly.

2. Description of the Related Art

Electrical connector assemblies are used in high temperature and high pressure environments. Current electrical connector assemblies that are used in such environments usually require the use of O-rings and a central cartridge to provide high temperature and pressure resistance. This configuration presents a drawback as O-rings require frequent inspection and maintenance in order to reduce the potential for breakdown and failure of the electrical connector. The central cartridge includes other components that also require additional inspection and maintenance to ensure continued reliability.

Accordingly, there is a need for a rotatable electrical connector assembly made up of fewer components that provides greater reliability and a high temperature and pressure interface.

SUMMARY OF THE INVENTION

A coupler for electrical connectors is disclosed. The coupler includes a body having a first end and a second end opposite the first end. The coupler further includes a first connection interface positioned at the first end of the body, the first connection interface having a first set of conductive rings. The coupler further includes a second connection interface positioned at the second end of the body, the second connection interface having a second set of conductive rings electrically connected to the first set of conductive rings.

An electrical connector is disclosed. The electrical connector includes a connection interface configured to interface with a coupler for an electrical connector. The electrical connector further includes one or more linear contact members positioned on the connection interface, each linear contact member being configured to contact a conductive ring on the coupler.

An electrical connector system is disclosed. The electrical connector system includes a coupler for an electrical connector having a first end and a second opposite the first end, and a connection interface positioned at the first end and comprising one or more conductive rings. The electrical connector system further includes an electrical connector having a connection interface configured to interface with the connection interface of the coupler, and at least one linear contact member positioned on the connection interface, the at least one linear contact member being configured to contact a conductive ring of the connection interface.

BRIEF DESCRIPTION OF THE DRAWINGS

The features and advantages of the embodiments of the present disclosure will become more apparent from the detailed description set forth below when taken in conjunction with the drawings. Naturally, the drawings and their associated descriptions illustrate example arrangements within the scope of the claims and do not limit the scope of the claims. Reference numbers are reused throughout the drawings to indicate correspondence between referenced elements.

DETAILED DESCRIPTION

In the following detailed description, numerous specific details are set forth to provide an understanding of the present disclosure. It will be apparent, however, to one of ordinary skill in the art that elements of the present disclosure may be practiced without some of these specific details. In other instances, well-known structures and techniques have not been shown in detail to avoid unnecessarily obscuring the present disclosure.

Figure 1:
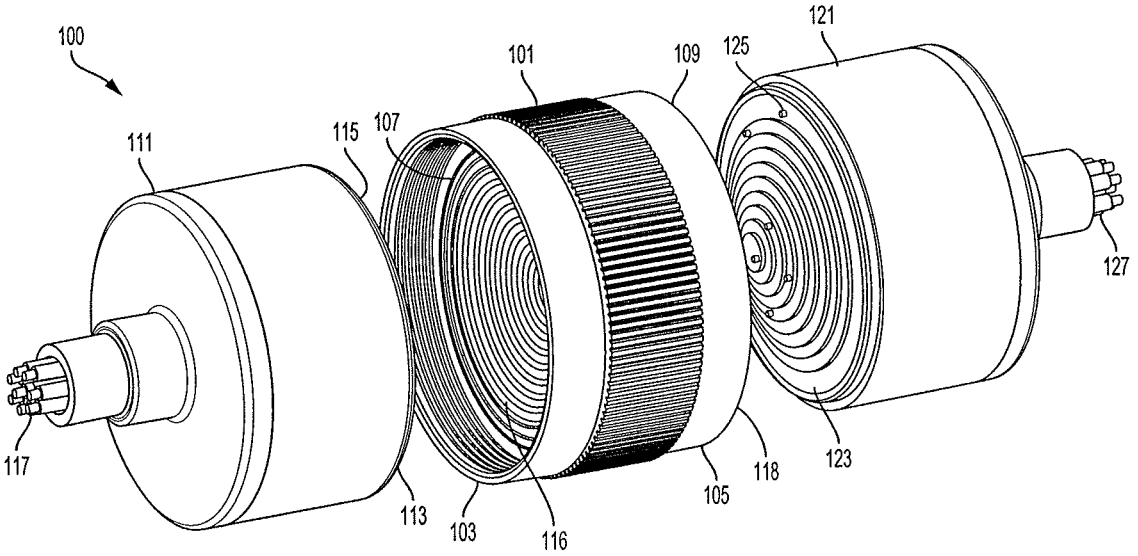
FIG. 1 is an exploded perspective view of an electrical connector system according to various aspects of the invention.

FIG. 1 is an exploded perspective view of an electrical connector system 100 having a coupler for electrical connectors (coupler) 101, a first electrical connector 111, and a second electrical connector 121 according to various aspects of the invention.

The coupler 101 has a first end 103, a second end 105 opposite the first end 103, a first connection interface 107 positioned at the first end 103, and a second connection interface 109 positioned at the second end 105. The first connection interface 107 includes a first conductive ring set 116 disposed on the first connection interface 107. The second connection interface 109 includes a second conductive ring set 118 disposed on the second connection interface 109. The first conductive ring set 116 and the second conductive ring set 118 may each include one or more conductive rings within their respective set.

The first conductive ring set 116 on the first connection interface 107 may be electrically connected to the second conductive ring set 118 on the second connection interface 109. Each ring within the first conductive ring set 116 may be individually connected to a corresponding ring within the second conductive ring set 118 such that the first conductive ring set 116 has an equal number of conductive rings as the second conductive ring set 118.

The first electrical connector 111 has a connection interface 113 with one or more linear contact members 115 positioned on the connection interface 113. The first electrical connector 111 may also have one or more conductive elements 117 in electrical communication with the one or more linear contact members 115.

The second electrical connector 121 may similarly have a connection interface 123 with one or more linear contact members 125 positioned on the connection interface 123. The second electrical connector 121 may also have one or more conductive elements 127 in electrical communication with the one or more linear contact members 125. In some embodiments, the linear contact members 115 and 125 may include one or more spring probes. In other embodiments, the linear contact members 115 and 125 may include one or more fixed pins.

The first electrical connector 111 and the second electrical connector 121 may be removably coupled to the coupler 101 via a mating surface. The mating surface may be in the form of screw threading, however, other forms of coupling may be used interchangeably. In some embodiments, the mating surface may further comprise one or more O-rings to facilitate improved sealing. In other embodiments, a mating surface may not be utilized within the electrical connector system 100.

Figure 2:
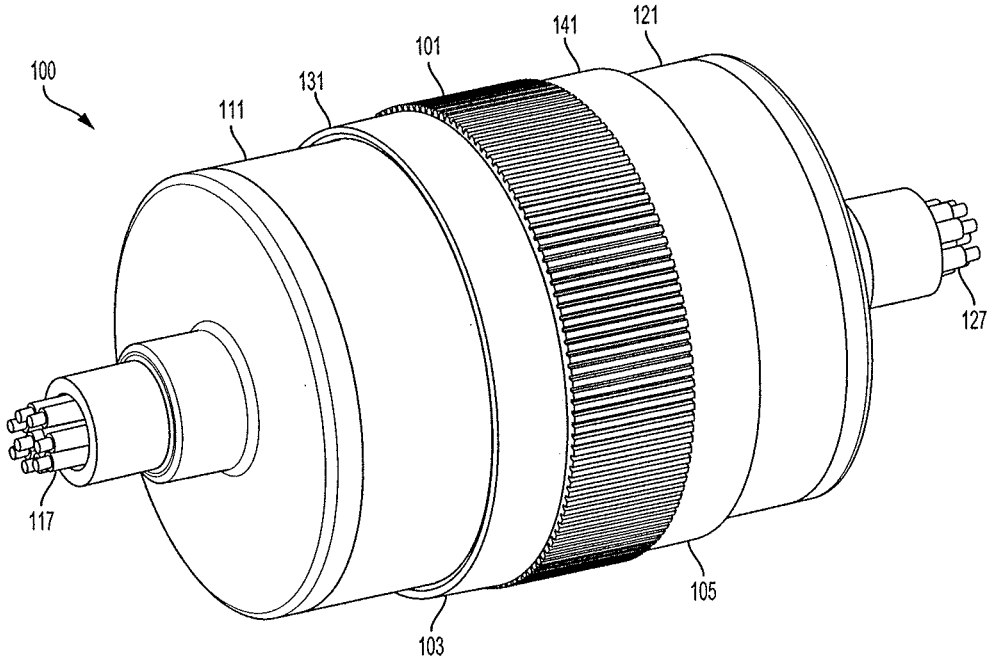
FIG. 2 is a perspective view of the electrical connector system of FIG. 1 according to various aspects of the invention.

When the first electrical connector 111 is coupled to the coupler 101, as depicted in FIG. 2, the linear contact members 115 are in electrical contact with the first conductive ring set 116 on the first connection interface 107. Similarly, when the second electrical connector 121 is coupled to the coupler 101, also depicted in FIG. 2, the linear contact members 125 are in electrical contact with the second conductive ring set 118 on the second connection interface 109.

When the first electrical connector 111, the coupler 101, and the second electrical connector 121 of the system 100 are coupled together, an electrical signal may travel through the conductive elements 117 on the first electrical connector 111 and be received by the linear contact members 115. From the linear contact members 115, the electrical signal travels through the first conductive ring set 116 at the first connection interface 107, through the second conductive ring set 118 at the second connection interface 109, through the linear contact members 125 positioned on the connection interface 123, and finally received by conductive elements 127 on the second electrical connector 121.

When the system 100 is coupled together, the first electrical connector 111 and the second electrical connector 121 may be able to freely rotate relative to the coupler 101. In some embodiments, only the first electrical connector 111 may be able to freely rotate relative to the coupler 101 when the system 100 is coupled together. In other embodiments, neither the first nor the second electrical connectors 111 and 121 may be able to freely rotate relative to the coupler 101 when the system 100 is coupled together.

In some embodiments, one or both of the first electrical connector 111 and the second electrical connector 121 may be connected to an apparatus such as a tool and contained within a hermetic enclosure. In some embodiments, the coupler 101 may form a bulkhead seal cap by being connected to a bulkhead. The coupler 101 may be connected to a mating surface of the bulkhead through brazing or any other attachment process used to create a hermetic seal.

The electrical connector system 100 may have various cross sectional geometries, for example, cylindrical, rectangular, square, or otherwise rotationally symmetric. By being rotationally symmetric, the linear contact members 115 and 125 do not need to be in rotational alignment with the first and second conductive ring sets 116 and 118, at their respective interfaces 107 and 109, in order to be in electrical contact or engaged. The linear contact members 115 and 125 only need to be in axial alignment with the first and second conductive rings sets 116 and 118 in order to be in electrical contact or engaged.

A user may connect the first electrical connector 111 to the coupler 101, without rotational alignment, by first moving the first electrical connector 111 into axial alignment with the coupler 101, and then moving the first electrical connector 111 axially towards the coupler 101 until the linear contact members 115 engage with the first conductive ring set 116. A user may similarly connect the second electrical connector 121 to the coupler 101, without rotational alignment, by first moving the second electrical connector 121 into axial alignment with the coupler 101, and then moving the second electrical connector 121 axially towards the coupler 101 until the linear contact members 125 engage with the second conductive ring set 118.

The linear contact members 115 may be in physical contact with the first conductive ring set 116 on the coupler 101 when they are engaged. Similarly, the linear contact members 125 may be in physical contact with the second conductive ring set 118 on the coupler 101 when they are engaged. In other embodiments, the linear contact members 115 and 125 may only be in electrical communication with the first and second conductive ring sets 116 and 118 on the coupler 101 when they are engaged despite not being in physical contact.

In some embodiments, the coupler 101 and the second electrical connector 121 may be integrated into a single combined component. The combined component may have the first end 103, the second end 105 opposite the first end 103, the first connection interface 107 positioned at the first end 103, and the one or more conductive elements 127 positioned at the second end 105. The first connection interface 107 may include the first conductive ring set 116 in electrical communication with the one or more conductive elements 127.

When the first electrical connector 111 and the combined component, as described above, are coupled together, an electrical signal may travel through the conductive elements 117 on the first electrical connector 111 and be received by the linear contact members 115. From the linear contact members 115, the electrical signal travels through the first conductive ring set 116 at the first connection interface 107, and finally received by the one or more conductive elements 127 positioned at the second end 103.

As depicted in FIG. 1, the first and second connection interface 107 and 109 are formed in an inverted stepped conic shape. However, the first connection interface 107 and the second connection interface 109, in system 100, may be formed in any shape or size. The first and second connection interface 107 and 109 may have a substantially planar shape, a conic shape, an inverted conic shape, a stepped conic shape, an inverted stepped conic shape, a convex shape (outwardly-curving), or a concave shape (inwardly-curving).

Both the connection interface 113 for the first electrical connector 111 and the connection interface 123 for the second electrical connectors 121 may be formed to complement the shape or size of the first and second connection interfaces 107 and 109 as described above. For example, if the first and second connection interfaces 107 and 109 are formed in an inverted conic shape, then the connection interfaces 113 and 123 are formed in a conic shape. As depicted in FIG. 1, the connection interfaces 113 and 123 for the first and the second electrical connectors 111 and 121 are formed in a stepped conic shape. In some embodiments, the connection interfaces 107 and 109 may be the same. In other embodiments, the connection interfaces 107 and 109 may be different.

FIG. 2 is a perspective view of the electrical connector system of FIG. 1 according to various aspects of the invention. FIG. 2 illustrates the first electrical connector 111 and the second electrical connector 121 coupled to the coupler 101.

The coupler 101 may include a first lip 131 and a second lip 141. The first lip 131 may extend to cover a first junction between the coupler 101 and the first electrical connector 111. The first junction is where the connection interface 113 on the first electrical connector 111 and the first connection interface 107 on the coupler 101 meet. The first lip 131 may be used to facilitate improved sealing between the first electrical connector 111 and the coupler 101. Similarly, the second lip 141 may extend to cover a second junction between the coupler 101 and the second electrical connector 121. The second junction is where the connection interface 123 on the second electrical connector 121 and the second connection interface 109 on the coupler 101 meet. The second lip 141 may similarly be used to facilitate improved sealing between the second electrical connector 121 and the coupler 101.

Figure 3:
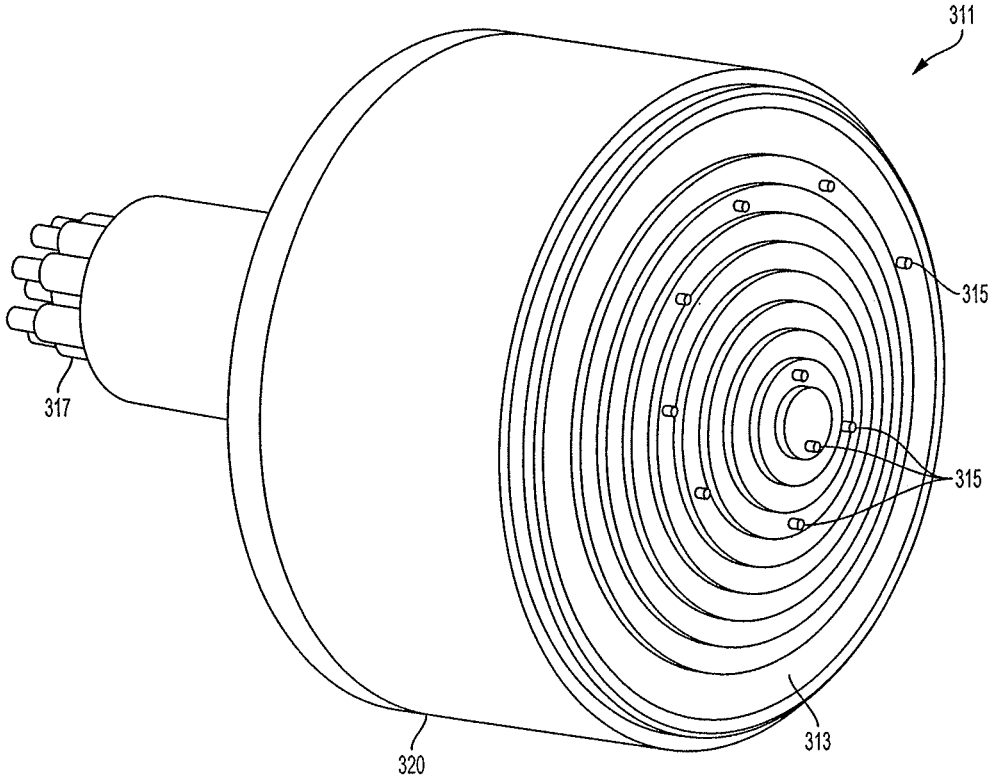
FIG. 3 is a perspective view of an electrical connector according to various aspects of the invention.

FIG. 3 is a perspective view of an electrical connector 311 according to various aspects of the invention. The electrical connector 311 is similar to the first electrical connector 111 and like parts are numbered similarly.

The electrical connector 311 may have a body 320 and a connection interface 313 with one or more linear contact members 315 positioned on the connection interface 313. The electrical connector 311 may have one or more conductive elements 317 in electrical communication with the linear contact members 315. In FIG. 3, the one or more conductive elements 317 are depicted as wires, however, other forms of conductive elements may be used interchangeably.

The linear contact members 315 may be configured to engage with one or more conductive rings on a coupler similar to the coupler 101 depicted in FIG. 1. In some embodiments, the linear contact members 315 may be spring probes. In other embodiments, the one or more linear contact members 315 may be fixed pins.

The connection interface 313 may be formed in any shape or size. The connection interface 313 may have a substantially planar shape, a conic shape, an inverted conic shape, a stepped conic shape, an inverted stepped conic shape, a convex shape (outwardly-curving), or a concave shape (inwardly-curving). As depicted in FIG. 3, the connection interface 313 is formed in a stepped conic shape.

The electrical connector 311 may have various cross sectional geometries, for example, cylindrical, rectangular, square, or otherwise rotational symmetric. By being rotationally symmetric, the linear contact members 315 do not need to be in rotational alignment with the conductive rings on a coupler, similar to the coupler 101 in FIG. 1, in order to be in electrical contact or engaged. As depicted in FIG. 3, the electrical connector 311 has a cylindrical cross sectional geometry.

In some embodiments, the body 320 may include a housing that defines a cavity between the housing and the linear contact members 315. The housing may be made out of a high temperature resistant material and/or electrical resistant material. The cavity may be an empty space such as a vacuum or may include an insulator disposed within the space. The insulator may be a co-fired ceramic insulator such as one formed from alumina-ceramic or other equivalent material.

An insulator may be disposed between the linear contact members 315 and form the connection interface 313. In FIG. 3, the insulator may form the rings of the stepped conic shape formed in the connection interface 313. In some embodiments, the insulator may form the connection interface 313 and be disposed within the cavity. In other embodiments, the insulator may form the body 320 of the electrical connector 311. That is, the insulator may be disposed between the linear contact members 315, form the connection interface 313, be disposed within the cavity, and form the housing of the electrical connector 311. The insulator may be a co-fired ceramic insulator such as one formed from alumina-ceramic or other equivalent material.

As depicted in FIG. 3, the linear contact members 315 are spaced out along the rings formed in the connection interface 313. In some embodiments, the linear contact members 315 may be similarly spaced out along the circumference of the connection interface 313 formed in a different shape. The spacing of the linear contact members 315 may be optimized to reduce noise in the electrical signal or to reduce the chances of a short from occurring. In other embodiments, the linear contact members 315 may be radially aligned along a central axis of the electrical connector 311.

Figure 4:
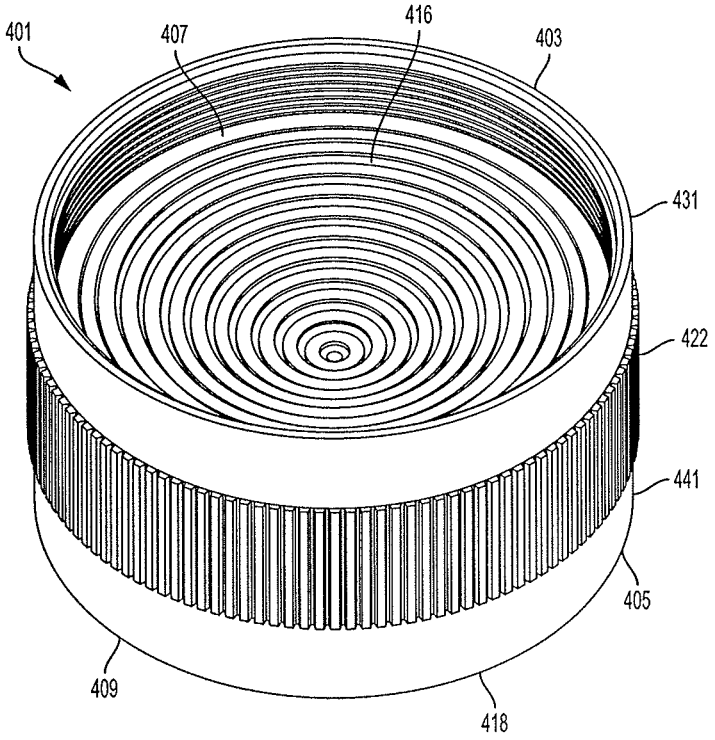
FIG. 4 is a perspective view of a coupler for electrical connectors according to various aspects of the invention.

FIG. 4 is a perspective view of a coupler for an electrical connector (coupler) 401 according to various aspects of the invention. The coupler 401 is similar to the coupler 101 and like parts are numbered similarly.

The coupler 401 has a first end 403, a second end 405 opposite the first end 403, a first connection interface 407 positioned at the first end 403, a second connection interface 409 positioned at the second end 405, and a body 422. The first connection interface 407 and the second connection interface 409 each include a conductive ring set (conductive rings) 416 and 418 are disposed on the respective connection interfaces 407 and 409.

The conductive ring set 416 on the first connection interface 407 may be electrically connected to the conductive ring set 418 on the second connection interface 409. Each ring within the conductive ring set 416 may be individually connected to a corresponding ring within the conductive ring set 418 such that there are an equal number of conductive rings between conductive ring sets 416 and 418.

Each ring within the conductive ring set 416 is electrically connected to a corresponding companion ring within the conductive ring set 418. In some embodiments, the conductive ring set 416 may be electrically connected to the conductive ring set 418 by one or more vertical interconnect accesses (VIAs). In other embodiments, the conductive ring set 416 may be electrically connected to the conductive ring set 418 by any other form of electrical connection.

Each ring within the conductive ring sets 416 and 418 may have its own discrete diameter. In some embodiments, a ring from conductive ring set 416 and its corresponding ring from conductive ring set 418 may have the same diameter. In other embodiments, a ring from conductive ring set 416 and its corresponding ring from the conductive ring set 418 may have different diameters. The different diameters may correspond to electrical connectors having connection interfaces of unequal size or shape.

As shown in FIG. 4, the conductive rings 416 and 418 comprise concentric circles about a common center. In some embodiments, one or more of the conductive rings 416 and 418 may not share a common center with the other rings. In other embodiments, one or more of the conductive rings 416 and 418 may form only partial circles or ellipses.

The connection interfaces 407 and 409 may be formed in any shape or size. The connection interfaces 407 and 409 may have a substantially planar shape, a conic shape, an inverted conic shape, a stepped conic shape, an inverted stepped conic shape, a convex shape (outwardly-curving), or a concave shape (inwardly-curving). As depicted in FIG. 4, the connection interface 407 is formed in an inverted stepped conic shape. In some embodiments, the connection interfaces 407 and 409 may be the same. In other embodiments, the connection interfaces 407 and 409 may be different.

In some embodiments, the body 422 may include a housing that defines a cavity between the housing and the conductive rings 416 and 418. The housing may be made out of a high temperature resistant material and/or electrical resistant material. The cavity may be an empty space such as a vacuum or may include an insulator disposed within the space. The insulator may be a co-fired ceramic insulator such as one formed from alumina-ceramic or other equivalent material.

An insulator may be disposed between each ring within the conductive ring sets 416 and 418. In some embodiments, the insulator may additionally be disposed between the one or more VIAs connecting the conductive ring set 416 to the conductive ring set 418. In other embodiments, the insulator may form the body 422 of the coupler 401. That is, the insulator may be disposed between each ring within the conductive rings sets 416 and 418, be disposed between the one or more VIAs, be disposed within the cavity, and form the housing of the coupler 401. The insulator may be a co-fired ceramic insulator such as one formed from alumina-ceramic or other equivalent material.

The coupler 401 may include a first lip 431 and a second lip 441. The first lip 431 may extend to cover a first junction between the coupler 401 and a first electrical connecter such as the first electrical connector 111 from FIG. 1. The first junction is where a connection interface on the first electrical connector 111 and the first connection interface 407 on the coupler 401 meet. The first lip 431 may be used to facilitate improved sealing between the first electrical connector 111 and the coupler 401. Similarly, the second lip 441 extends to cover a second junction between the coupler 401 and a second electrical connector such as the second electrical connector 121 from FIG. 1. The second junction is where a connection interface on the second electrical connector 121 and, the second connection interface 409 on the coupler meet. The second lip 441 may similarly be used to facilitate improved sealing between the second electrical connector 121 and the coupler 401.

The first lip 431 and the second lip 441 may further include mating surfaces to removably couple the coupler 401 to a first and second electrical connector. As shown in FIG. 4, the mating surface is disposed along an interior surface of the first lip 431. In other embodiments, the mating surface may be disposed along an exterior surface of the first lip 431 and the second lip 441. The mating surface may be in the form of screw threading, however, other forms of coupling may be used interchangeably. In some embodiments, the mating surface may further include one or more O-rings to facilitate improved sealing. In other embodiments, a mating surface may not be utilized with the coupler 401.

Figure 5:
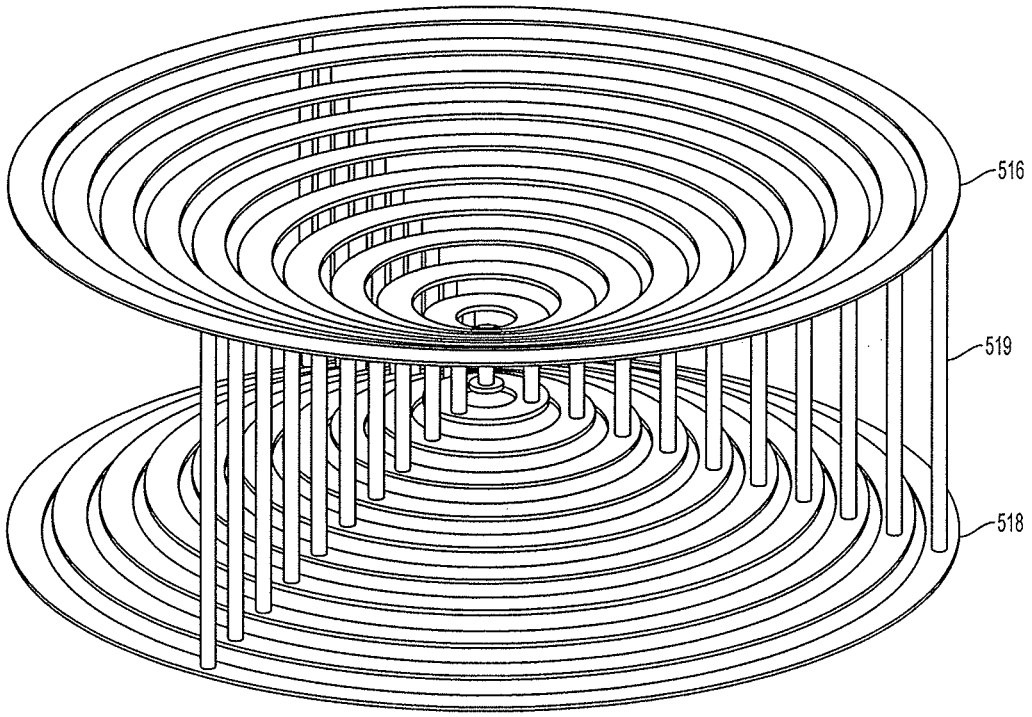
FIG. 5 is a perspective view of conductive rings according to various aspects of the invention.

FIG. 5 is a perspective view of conductive ring sets 516 and 518 according to various aspects of the invention. The conductive ring sets 516 and 518 are similar to the conductive ring sets 116 and 118, and like parts are numbered similarly.

The rings within the conductive ring set 516 are electrically connected to the rings within the conductive ring set 518 by one or more vertical interconnect accesses (VIAs) 519. As shown in FIG. 5, each ring is connected to a corresponding ring by three (3) VIAs 519. In other embodiments, any number of VIAs 519 may be used to connect corresponding rings between conductive ring sets 516 and 518.

The conductive rings within the conductive ring sets 516 and 518 include concentric circles about a common center. In some embodiments, one or more of the conductive rings may not share a common center with the other rings. In other embodiments, one or more of the conductive rings may form only partial circles or ellipses.

The conductive rings within the conductive rings sets 516 and 518 are arranged to be disposed within a corresponding interface on a coupler similar to the coupler 101 in FIG. 1. The arrangement of the conductive rings, within the conductive ring sets 516 and 518, may be formed to any shape or size. The arrangement of the conductive rings, within the conductive ring sets 516 and 518, may be formed to fit within a substantially planar shape, a conic shape, an inverted conic shape, a stepped conic shape, an inverted stepped conic shape, a convex shape (outwardly-curving), or a concave shape (inwardly-curving). As depicted in FIG. 5, the rings within the conductive ring sets 516 and 518 are arranged to fit within an inverted stepped conic shape.

Figure 6:
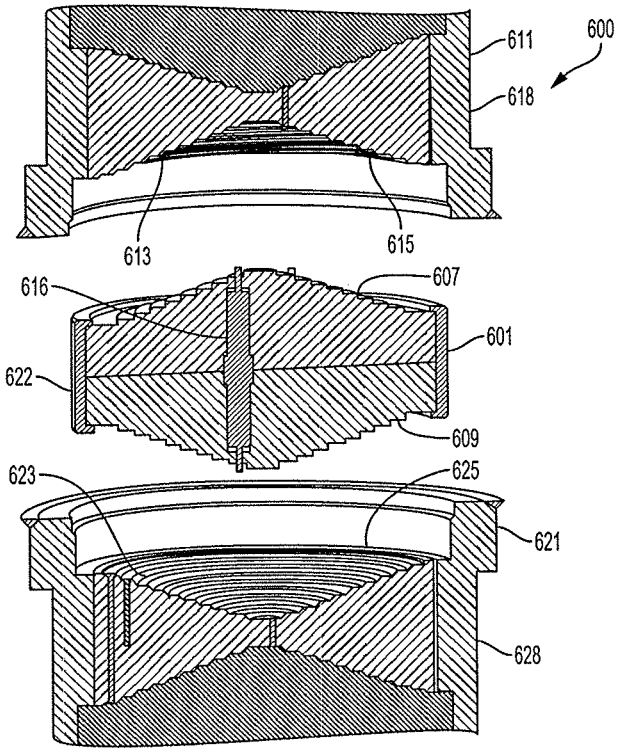
FIG. 6 is an exploded perspective view of an electrical connector system according to various aspects of the invention.

FIG. 6 is an exploded perspective view of an electrical connector system 600 having a coupler for electrical connectors (coupler) 601, a first electrical connector 611, and a second electrical connector 621 according to various aspects of the invention.

The coupler 601 has a body 622, a first connection interface 607, and a second connection interface 609. One or more linear contact members (linear contact member) 616 are positioned both on the first connection interface 607 and the second connection interface 609. The linear contact member 616 provides electrical communication between the first connection interface 607 and the second connection interface 609. In some embodiments, the one or more linear contact members 616 may be spring probes. In other embodiments, the one or more linear contact members 616 may be fixed pins.

The first connection interface 607 and the second connection interface 609 may be formed in any shape or size. The first connection interface 607 and the second connection interface 609 may have a substantially planar shape, a conic shape, an inverted conic shape, a stepped conic shape, an inverted stepped conic shape, a convex shape (outwardly-curving), or a concave shape (inwardly-curving). As depicted in FIG. 6, the first connection interface 607 and the second connection interface 609 is formed in a stepped conic shape.

In some embodiments, the body 622 may include a housing that defines a cavity between the housing and the linear contact member 616. The housing may be made out of a high temperature resistant material and/or electrical resistant material. The cavity may be an empty space such as a vacuum or may include an insulator disposed within the space. The insulator may be a co-fired ceramic insulator such as one formed from alumina-ceramic or other equivalent material.

An insulator may be disposed between the linear contact member 616 and form the first connection interface 607 and the second connection interface 609. In FIG. 6, the insulator may form the rings of the stepped conic shape formed on the first connection interface 607 and the second connection interface 609. In some embodiments, the insulator may form the first connection interface 607, the second connection interface 609, and be disposed within the cavity. In other embodiments, the insulator may form the body 622 of the coupler 601. The insulator may be a co-fired ceramic insulator such as one formed from alumina-ceramic or other equivalent material.

The first electrical connector 611 has a body 618 and connection interface 613 that includes a conductive ring set 615 disposed on the connection interface 613. The conductive ring set 615 may include one or more conductive rings within the set. In some embodiments, the conductive ring set 615 is configured to be engaged by the one or more linear contact members 616. Each ring within the conductive ring set 615 is electrically connected to one or more conductive elements. In some embodiments, the conductive ring set 615 may be electrically connected to the one or more conductive elements by one or more vertical interconnect accesses (VIAs). In other embodiments, the conductive ring set 615 may be electrically connected to the one or more conductive elements by any other form of electrical connection.

In some embodiments, the body 618 may include a housing that defines a cavity between the housing 618 and the conductive ring set 615. The housing may be made out of a high temperature resistant material and/or electrical resistant material. The cavity may be an empty space such as a vacuum or may include an insulator disposed within the space. The insulator may be a co-fired ceramic insulator such as one formed from alumina-ceramic or other equivalent material.

An insulator may be disposed between each ring within the conductive ring set 615. In some embodiments, the insulator may additionally be disposed between the one or more VIAs connecting the conductive ring set 615 to the one or more conductive elements. In other embodiments, the insulator may form the body 618 of the first electrical connector 611. That is, the insulator may be disposed between each ring within the conductive rings set 615, be disposed between the one or more VIAs, be disposed within the cavity, and form the housing of the first electrical connector 611. The insulator may be a co-fired ceramic insulator such as one formed from alumina-ceramic or other equivalent material.

Similarly, the second electrical connector 621 has a body 628 and connection interface 623 that includes a conductive ring set 625 disposed on the connection interface 623. The conductive ring set 625 may include one or more conductive rings within the set. In some embodiments, the conductive ring set 625 is configured to be engaged by the one or more linear contact members 616. Each ring within the conductive ring set 625 is electrically connected to one or more conductive elements. In some embodiments, the conductive ring set 625 may be electrically connected to the one or more conductive elements by one or more vertical interconnect accesses (VIAs). In other embodiments, the conductive ring set 625 may be electrically connected to the one or more conductive elements by any other form of electrical connection.

In some embodiments, the body 628 may include a housing that defines a cavity between the housing 628 and the conductive ring set 625. The housing may be made out of a high temperature resistant material and/or electrical resistant material. The cavity may be an empty space such as a vacuum or may include an insulator disposed within the space. The insulator may be a co-fired ceramic insulator such as one formed from alumina-ceramic or other equivalent material.

An insulator may be disposed between each ring within the conductive ring set 625. In some embodiments, the insulator may additionally be disposed between the one or more VIAs connecting the conductive ring set 625 to the one or more conductive elements. In other embodiments, the insulator may form the body 628 of the first electrical connector 621. That is, the insulator may be disposed between each ring within the conductive rings set 625, be disposed between the one or more VIAs, be disposed within the cavity, and form the housing of the first electrical connector 621. The insulator may be a co-fired ceramic insulator such as one formed from alumina-ceramic or other equivalent material.

The first electrical connector 611 and the second electrical connector 621 may be removably coupled to the coupler 601 via a mating surface. The mating surface may be in the form of screw threading, however, other forms of coupling may be used interchangeably. In some embodiments, the mating surface may further comprise one or more O-rings to facilitate improved sealing. In other embodiments, a mating surface may not be utilized within the electrical connector system 600.

When the first electrical connector 611 is coupled to the coupler 601 the linear contact members 616 are in electrical contact with the conductive ring set 615. Similarly, when the second electrical connector 621 is coupled to the coupler 601 the linear contact members 616 are in electrical contact with the conductive ring set 625.

When the first electrical connector 611, the coupler 601, and the second electrical connector 621 of the system 600 are coupled together, an electrical signal may travel through the conductive elements on the first electrical connector 611 and be received by the conductive ring set 615. From the conductive ring set 615, the electrical signal travels through the linear contact members 616, through the conductive ring set 625, and finally received by conductive elements on the second electrical connector 621.

When the system 600 is coupled together, the first electrical connector 611 and the second electrical connector 621 may be able to freely rotate relative to the coupler 601. In some embodiments, only the first electrical connector 611 may be able to freely rotate relative to the coupler 601 when the system 600 is coupled together. In other embodiments, neither the first nor the second electrical connectors 611 and 621 may be able to freely rotate relative to the coupler 601 when the system 600 is coupled together.

In some embodiments, one or both of the first electrical connector 611 and the second electrical connector 621 may be hermetically sealed and connected to an apparatus such as a tool. One or both of the first electrical connector 611 and the second electrical connector 621 may be connected to the apparatus through brazing or any other attachment process used to create a hermetic seal. In other embodiments, both the first electrical connector 611 and the coupler 601 may be similarly connected to the apparatus through brazing or any other attachment process used to create a hermetic seal.

The electrical connector system 600 may have various cross sectional geometries, for example, cylindrical, rectangular, square, or otherwise rotationally symmetric. By being rotationally symmetric, the linear contact members 616 do not need to be in rotational alignment with the conductive ring sets 615 and 625, at their respective interfaces 613 and 623, in order to be in electrical contact or engaged. The linear contact members 616 only need to be in axial alignment with the conductive rings sets 615 and 625 in order to in electrical contact or engaged.

A user may connect the first electrical connector 611 to the coupler 601, without rotational alignment, by first moving the first electrical connector 611 into axial alignment with the coupler 601, and then moving the first electrical connector 611 axially towards the coupler 601 until the linear contact members 616 engage with the conductive ring set 615. A user may similarly connect the second electrical connector 621 to the coupler 601, without rotational alignment, by first moving the second electrical connector 621 into axial alignment with the coupler 601, and then moving the second electrical connector 621 axially towards the coupler 601 until the linear contact member 616 engage with the conductive ring set 625.

The linear contact members 616 may be in physical contact with the conductive ring set 615. Similarly, the linear contact members 616 may be in physical contact with the conductive ring set 625 when they are engaged. In other embodiments, the linear contact members 616 may only be in electrical communication with the conductive ring sets 615 and 625 when they are engaged despite not being in physical contact.

As depicted in FIG. 6, the first and second connection interface 607/609 is formed in a stepped conic shape. However, the first connection interface 607 and the second connection interface 609, in system 600, may be formed in any shape or size. The first and second connection interface 607 and 609 may have a substantially planar shape, a conic shape, an inverted conic shape, a stepped conic shape, an inverted stepped conic shape, a convex shape (outwardly-curving), or a concave shape (inwardly-curving).

The connection interfaces. 613 for the first electrical connector 611 and the connection interface 623 for the second electrical connectors 621 may be formed to complement the shape or size of the first and second connection interface 607 and 609 as described above. For example, if the first and second connection interface 607 and 609 are formed in a conic shape, then the connection interfaces 613 and 623 are formed in an inverted conic shape. As depicted in FIG. 6, the connection interfaces 613 and 623 for the first and the second electrical connectors 611 and 621 are formed in an inverted stepped conic shape. In some embodiments, the connection interfaces 607 and 609 may be the same. In other embodiments, the connection interfaces 607 and 609 may be different.

The foregoing description of the disclosed example embodiments is provided to enable any person of ordinary skill in the art to make or use the present invention. Various modifications to these examples will be readily apparent to those of ordinary skill in the art, and the principles disclosed herein may be applied to other examples without departing from the spirit or scope of the present invention. The described embodiments are to be considered in all respects only as illustrative and not restrictive and the scope of the invention is, therefore, indicated by the following claims rather than by the foregoing description. All changes which come within the meaning and range of equivalency of the claims are to be embraced within their scope.

What is claimed is:

1. A coupler for electrical connectors, comprising:

a body having a first end and a second end opposite the first end;

a first connection interface positioned at the first end of the body, the first connection interface having a first set of conductive rings, each conductive ring of the first set of conductive rings having a different diameter, the first set of conductive rings arranged in a stepped conic or an inverted stepped conic shape; and a second connection interface positioned at the second end of the body, the second connection interface having a second set of conductive rings, the second set of conductive rings having the same diameters as the first set of conductive rings and arranged in the stepped conic or the inverted stepped conic shape, each conductive ring of the first set of conductive rings and the second set of conductive rings having the same diameter and being electrically connected to each other by one or more vertical interconnect accesses (VIAs).

2. The coupler of claim 1, further comprising an insulator between a portion of the one or more VIAs, the first set of conductive rings or the second set of conductive rings.

3. The coupler of claim 1, wherein the body is configured to be connected to a mating surface by a hermetic sealing process.

4. The coupler of claim 1, wherein the first connection interface and the second connection interface are formed in a substantially planar shape.

5. The coupler of claim 1, wherein a diameter of an outer ring of the first set of conductive rings and a diameter of an outer ring of the second set of conductive rings is greater than a diameter of an inner ring of the first set of conductive rings and a diameter of an inner ring of the second set of conductive rings.

6. An electrical connector system, comprising:

a coupler for an electrical connector having:

a first end and a second end opposite the first end, a first connection interface positioned at the first end and comprising a first set of conductive rings, each conductive ring of the first set of conductive rings having a different diameter, the first set of conductive rings arranged in a stepped conic or an inverted stepped conic shape, and a second connection interface positioned at the second end and comprising a second set of conductive rings having the same diameters as the first set of conductive rings and arranged in the stepped conic or the inverted stepped conic shape, each conductive ring of the first set of conductive rings and the second set of conductive rings having the same diameter and being electrically connected to each other by one or more vertical interconnect accesses (VIAs); and an electrical connector having:

a connection interface configured to interface with the first connection interface of the coupler, and at least one linear contact member positioned on the connection interface, the at least one linear contact member being configured to contact a conductive ring of the first connection interface.

7. The electrical connector system of claim 6, further comprising:

a second electrical connector, the second electrical connector having:

a connection interface configured to interface with the second connection interface of the coupler, and at least one linear contact member positioned on the connection interface, the at least one linear contact member being configured to contact a conductive ring of the second connection interface.

8. The electrical connector system of claim 6, wherein the connection interface of the coupler and the connection interface of the electrical connector are formed in a substantially planar shape.

9. The electrical connector system of claim 6, wherein the connection interface of the electrical connector is formed in a stepped conic shape.

10. The electrical connector system of claim 6, wherein the at least one linear contact members include a spring probe or a fixed pin.

11. The electrical connector system of claim 6, further comprising an insulator between a portion of the one or more VIAs, the first set of conductive rings of the first connection interface, or the at least one linear contact member.

* * * * *